US011078011B2

(12) United States Patent
Lipp

(10) Patent No.: US 11,078,011 B2
(45) Date of Patent: Aug. 3, 2021

(54) CONTAINER, PRODUCED FROM A SPIRAL-SHAPED, BENT SHEET STRIP

(71) Applicant: Xaver Lipp, Ellwangen (DE)

(72) Inventor: Xaver Lipp, Ellwangen (DE)

(73) Assignee: Xaver Lipp, Ellwangen (DE)

( * ) Notice: Subject to any disclaimer, the term of this patent is extended or adjusted under 35 U.S.C. 154(b) by 956 days.

(21) Appl. No.: 15/034,561

(22) PCT Filed: Oct. 24, 2014

(86) PCT No.: PCT/EP2014/002872

§ 371 (c)(1),
(2) Date: May 5, 2016

(87) PCT Pub. No.: WO2015/078546

PCT Pub. Date: Jun. 4, 2015

(65) Prior Publication Data

US 2016/0272415 A1 Sep. 22, 2016

(30) Foreign Application Priority Data

Nov. 27, 2013 (DE) ..... 10 2013 020 340.6

(51) Int. Cl.
*B65D 88/08* (2006.01)
*B65D 90/08* (2006.01)
*B65D 90/02* (2019.01)

(52) U.S. Cl.
CPC ..... *B65D 88/08* (2013.01); *B65D 90/029* (2013.01); *B65D 90/08* (2013.01)

(58) Field of Classification Search
CPC ... B65D 7/04; B65D 7/46; B65D 7/38; B65D 88/08; B65D 90/029; B65D 90/08;
(Continued)

(56) References Cited

U.S. PATENT DOCUMENTS 1,495,653 A * 5/1924 Thomas ..... B65D 7/38
220/4.06
3,078,818 A * 2/1963 Butler ..... B21C 37/122
228/145

(Continued)

FOREIGN PATENT DOCUMENTS

| | | |
|---|---|---|
| AT | 374 877 | 6/1984 |
| DE | 20 2004 015 154 | 2/2005 |
| DE | 10 2012 018 935 | 3/2014 |

OTHER PUBLICATIONS

International Search Report (ISR) dated Jan. 30, 2015 in International (PCT) Application No. PCT/EP2014/002872.

*Primary Examiner* — Andrew D Perreault
(74) *Attorney, Agent, or Firm* — Wenderoth, Lind & Ponack, L.L.P.

(57) ABSTRACT

A container (10) is produced from a spiral-shaped, bent sheet strip (20) having a first edge section (22) extending in a spiral shape, being bent, and forming a bending edge (24) extending in a spiral shape toward the inside or the outside of the container (10). The sheet strip (20) has a second edge section (32) opposite the first edge section (22) in the longitudinal direction of the sheet strip (20) and extends in a spiral shape. The second edge section (32) overlaps a third section (28) opposite the first edge section (22) in relation to the bending edge (24) and is adjacent to the bending edge (24). The second edge section (32) and the third section (28) are welded to each other in the region of the overlap (30). The welding seam (40) extends at least partially into the region between the second edge section (32) and the third section (28) of the sheet strip (20).

19 Claims, 5 Drawing Sheets

(58) Field of Classification Search
CPC ... E04H 7/06; B29C 66/12842; B21C 37/122; B23K 11/068; B23K 11/084; B23K 26/302; B23K 5/086; B23K 9/0325
USPC ..... 206/524.6; 220/678, 680; 52/82, 847; 228/145
See application file for complete search history.

(56) References Cited

U.S. PATENT DOCUMENTS

| | | | | | |
|---|---|---|---|---|---|
| 3,380,147 | A | | 4/1968 | McDonald | |
| 4,074,847 | A | * | 2/1978 | McFatter | B23K 9/0325 228/145 |
| 4,337,600 | A | | 7/1982 | Hansen | |
| 5,476,210 | A | * | 12/1995 | Hodozuka | B23K 9/02 228/165 |
| 6,138,861 | A | | 10/2000 | Palazzo | |
| 2014/0016993 | A1 | * | 1/2014 | Itoh | B32B 37/18 403/270 |

* cited by examiner

CONTAINER, PRODUCED FROM A SPIRAL-SHAPED, BENT SHEET STRIP

FIELD OF THE INVENTION

The invention relates to a container produced from a spiral-shaped, curved sheet strip, which may be used, for example, as storage container for liquid or solid agricultural produce or waste, or as biogas reactor.

BACKGROUND OF THE INVENTION

The production of containers of this kind is known from DE 2 250 239 A. In this method, a sheet strip is used to form a spiral with a diameter that corresponds to that of the container diameter. The associated, spiral-shaped sheet strip edges are folded out and then connected to each other on the outside of the container by a seam. This manufacturing method, known as the LIPP double-seam system, provides for a quick and simple manufacture of containers of different diameters and different heights. By using mobile sheet folding and assembly facilities, the container may be manufactured directly at the desired erection site.

From the document DE 199 39 180 A1 a container made from a spiral-shaped, curved sheet strip is known, in which a first edge section is folded towards the outside, thus forming a spiral-shaped fold-out edge. The second edge section of the sheet strip is also folded to the outside and connected to the first edge section by an outside seam. In the vicinity of the butt joint of the folded edge sections, the sheet strip is welded on the inside of the container for sealing purposes.

For common applications such as, for example, the storage of bulk material from the agricultural or forestry sectors, or of bio waste, the manufactured containers seal very well, are structurally stable and are media resistant. Further applications such as, for example, the storage of plant-based oils, require a greater container volume, and thus, a significantly increased mechanical rigidity of the containers to be economically viable. Such containers can so far only be achieved with manufacturing methods that involve a significantly greater investment in terms of time and cost.

SUMMARY OF THE INVENTION

An object of the invention involves providing an improved container that is produced from a spiral-shaped sheet strip and further increases the application spectrum of containers of this kind, in particular a large storage volume and/or an increased mechanical rigidity, while being still simple and quick to produce.

This object is basically met by a container produced from a spiral-shaped, curved sheet strip. The sheet strip comprises a first spiral-shaped edge section that is folded to the inside or to the outside of the container to form a spiral-shaped fold-out edge. The sheet strip features a second edge section which, with regard to the longitudinal direction of the sheet strip, is disposed opposite the first edge section and which also extends spiral-shaped. The second edge section of the sheet strip overlaps a third section of the sheet strip which, with regard to the fold-out edge, is disposed opposite the first edge section and adjoins the fold-out edge. The second edge section and the third section of the sheet strip are welded together in the vicinity of the overlap, where the welding seam extends at least partially into the area between the second edge section and the third section of the sheet strip.

As a result of the spread of the welding seam up to at least the edge region of the overlap between the second edge section and the third section, where the edge region adjoins the fold-out edge, a break-proof, mechanical connection of the sheet strip edges is achieved. The mechanical connection provides sufficient mechanical rigidity even in large-volume containers for the storage of liquid media. The welding seam is in this instance located preferably in the region of the fold-out edge. The fold-out edge may in particular be partially or even fully covered by the welding seam. The overlap of the third section by the second edge section is preferably a multiple of the thickness of the sheet strip, in particular more than two times and preferably more than three times the sheet thickness. The overlapping of the third section by the second edge section is in vertical direction. The first edge section and the second edge section each show the longitudinal edge of the sheet strip.

In one embodiment, the height of the welding seam is more than 100%, in particular more than 120% and preferably more than 150% of the thickness of the sheet strip, in particular the thickness of the sheet strip in the vicinity of the fold-out edge. The sheet strip has preferably a constant thickness over its entire extension in longitudinal and transverse direction. The height of the welding seam ensures that the welding seam does not constitute a bottleneck for the flow of force so that the effective forces that extend from the third section via the welding seam into the second edge section are certainly and reliably transferred without the occurrence of force peaks, and thus, without stress peaks in the vicinity of the welding seam.

In one embodiment the height of that part of the welding seam that extends in the vicinity between the edge section and the third section of the sheet strip is more than 20%, in particular more than 25% and preferably more than 30% of the thickness of the sheet strip, in particular of the thickness of the sheet strip in the vicinity of the welding seam. This structure causes the forces to be transferred via the welding seam also into that area of the sheet strip, in particular into that area of the third section of the sheet strip that remained mechanically essentially without load due to being folded out and the formation of the fold-out edge. This arrangement leads to a significantly increased rigidity of the welding connection.

In one embodiment welding is performed at least partially also in the vicinity of the fold-out edge. for example, the fold-out edge may be covered partially or even fully by the welding seam. This structure further increases the mechanical rigidity of the welding seam since, in particular, the areas of the sheet strip that are close to the surface that have been stressed through folding out are melted by the welding process in the vicinity of the fold-out edge and become a part of the welding seam after solidifying.

In one embodiment, the welding seam extends into that area in which the second edge section and the third section extend parallel to each other. The second edge section and the third section of the sheet strip may, in the vicinity of the overlap, extend parallel and in particular concentric to each other in the direction of the circumference. Additionally, the second and third sections may have a constant distance to each other or they may be in contact with each other already. Both have a favorable effect on the rigidity of the welding connection.

In one embodiment, the second edge section overlaps the third section of the sheet strip on the inside of the container. In this instance the first edge section may be folded outwards so that the fold-out edge is accessible from the outside and the welding process in particular can take place from the outside of the container to be manufactured. This arrangement significantly simplifies the manufacturing process, in particular because the welding device does not have to be moved from the inside of the container to the outside after completion of the manufacturing process.

In one embodiment the second edge section is welded with its spiral-shaped end edge to the third section of the sheet strip. This welding connection may be implemented as an alternative to or in addition to the welding connection in the vicinity of the fold-out edge. Provided that the second edge section overlaps the third section on the inside of the container, the container is also fluid-tight on the inside, and the occurrence of germ pockets is reliably prevented, which is particularly important for the storage of foodstuffs.

In one embodiment an end edge of the second edge section preferably forms a step that extends obliquely or transverse to the vertical longitudinal axis of the container on the inside of the container. This simplifies the welding process because the welding seam can be formed reliably at the butt joint of the two sheet sections at the area of the step that extends oblique or transverse in particular.

In one embodiment the fold-out edge is formed by the first edge section that is folded towards the outside of the container, where the first edge section is disposed above the opposite second edge section in relation to the longitudinal direction of the sheet strip. The fold-out is performed essentially at right angles, and the length of the folded out section is in one embodiment more than two times, in particular more than three times and preferably more than five times the thickness of the sheet strip. This arrangement increases the mechanical rigidity of the container. As a result of the sill-shaped, radially outward protruding, first edge section, the externally located welding seam can be applied in a very simple manner. In particular, the welding plant may be guided at an acute angle of preferably more than 20° and less than 70° with respect to the horizontal at the butt joint of the second edge section and the fold-out edge. The guiding permits the simple production of a sufficiently deep welding seam, and thus, forms a sufficiently rigid welding connection.

In one embodiment, the third section of the sheet strip, which adjoins the fold-out edge in the direction of the second edge section, is folded out as an offset with respect to a fourth section of the sheet strip. This fourth section adjoins the offset in the direction of the second edge section, and is in particular folded towards the outside of the container. This arrangement allows the matching edge sections of the sheet strip to be laid alongside each other without, or with only reduced, mechanical tension. If the offset is of sufficient size, a self-adjustment of the matching edges of the sheet strips to each other occurs. In particular, the second edge section is able to brace itself on the offset disposed between the third section and the fourth section, which further simplifies the manufacturing process, increases the rigidity and ensures an accurately fitting connection.

In one embodiment, the radial displacement of the second edge section compared to the fourth section of the sheet strip, caused by the offset, is less than 95% of the thickness of the sheet strip, in particular less than 90% and preferably less than 85%. This radial displacement causes the two matching edge sections to be slightly elastically deformed during manufacture, although they lay alongside each other in a pre-stressed state. This structure leads to a further stiffening of the container.

In one embodiment, the second edge section is, through a further offset, folded preferably into the inside of the container with respect to a fifth section. The fifth section continues on from the offset in the direction of the first edge section. This offset may be disposed in the vicinity of the radially outside located, fold-out edge of the first edge section. The radial displacement of the second edge section with respect to the fifth section, caused by the offset, may be less than 95% of the sheet strip thickness, in particular less than 90% and preferably less than 85%.

In one embodiment, the container is surrounded by a stabilizing device, which extends upwards from the support surface of the container, and which is at least sectionally and/or at discrete positions positively connected to the container. In particular, it is positively connected in radial direction so as to at least partially absorb the forces acting upon the container. In this instance, the stabilizing device may extend to at least part of the height of the container, in particular more than 20% and preferably more than 30%. The positive connections may be made at discrete locations around the circumference and/or in vertical direction, for example, through welding the radially outwardly folded, first edge section to the stabilizing device. The stabilizing device may be formed, for example, through several stabilizing elements, for example U-shaped elements or elements of triangular shape in lateral elevation, which are erected preferably equidistant around the circumference of the container, are anchored in the foundation and extend vertically.

In one embodiment the stabilizing device is formed by an outer container. The annular space in between the container and the outer container may at least sectionally and/or at least partially be filled with a material that provides a positive connection between the container and the outer container. For example, the space in between may be filled with concrete. In this instance the container and the outer container may be disposed concentrically on a foundation slab of the container.

The characteristics mentioned in the claims and in the description may be essential to the invention, individually or in any combination.

Other objects, advantages and salient features of the present invention will become apparent from the following detailed description, which, taken in conjunction with the drawings, discloses preferred embodiments of the present invention.

BRIEF DESCRIPTION OF THE DRAWINGS

Referring to the drawings that form a part of this disclosure.

DETAILED DESCRIPTION OF THE INVENTION

Figure 1:
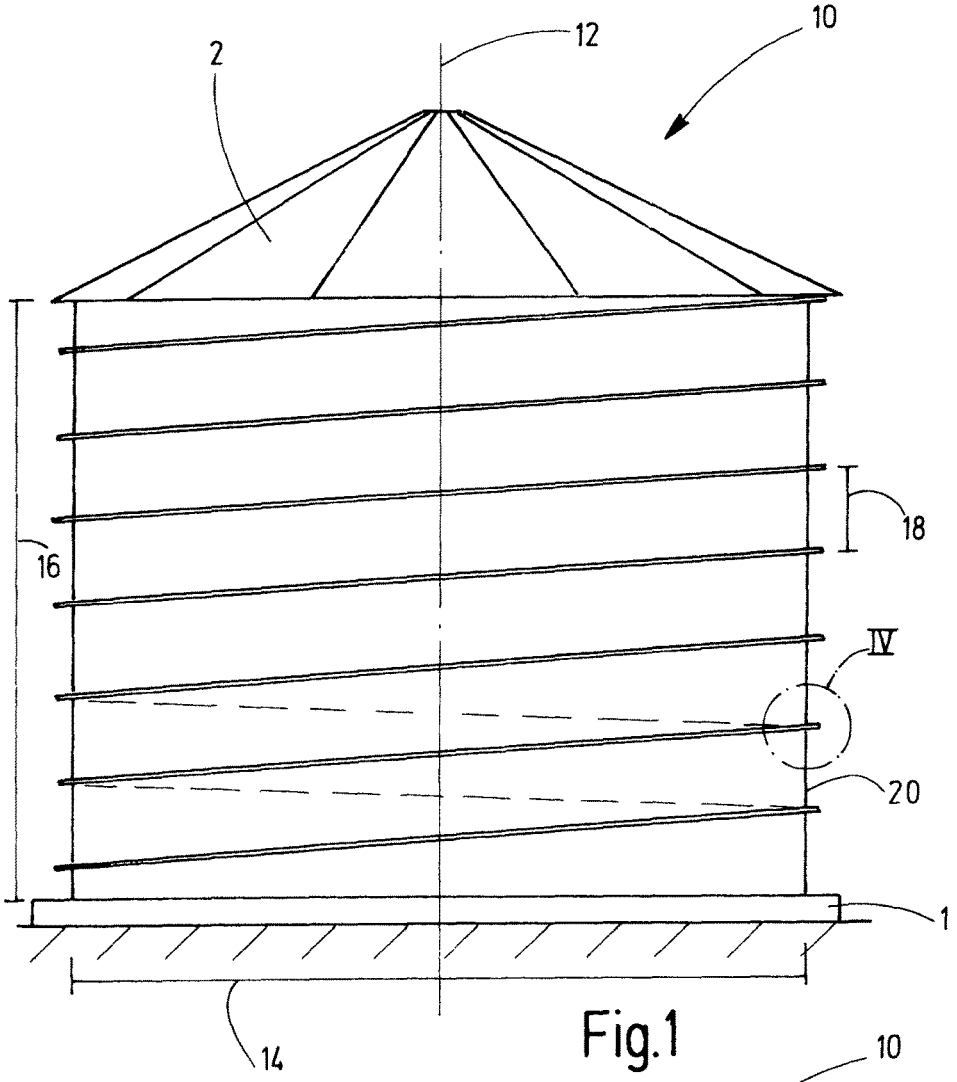
FIG. 1 is a side elevational view of a container according to the invention.
Figure 2:
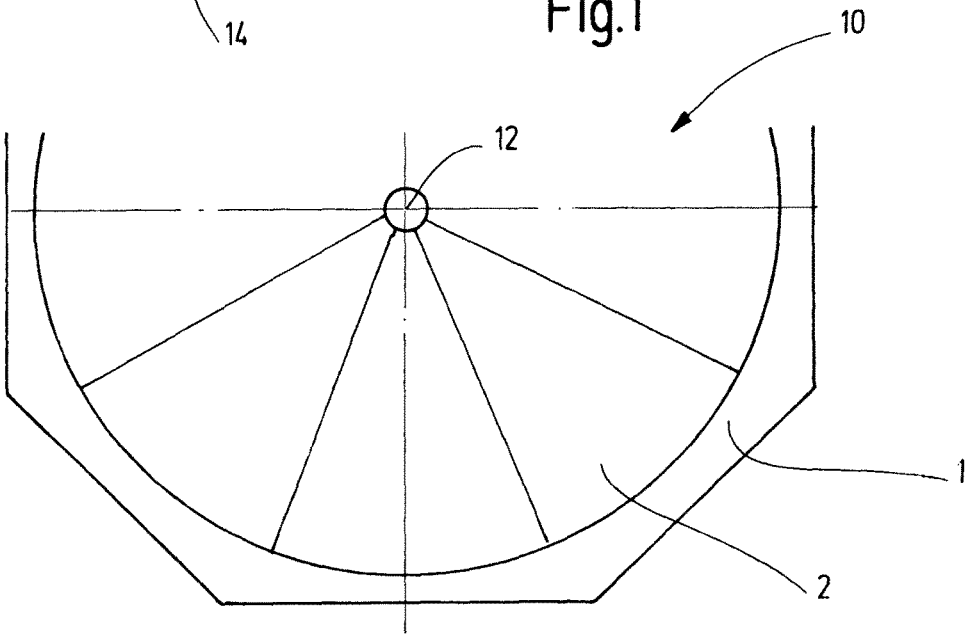
FIG. 2 is a partial plan view of the container in FIG. 1.

FIG. 1 depicts a side elevational view of a container 10 according to the invention that may be used for the storage of bulk material in the agricultural and forestry sectors, for example, grains, woodchips or bio waste as well as for the storage of water, waste water, sewage sludge, liquid energy carriers and also for the storage of gas. FIG. 2 is a partial plan view of the container in FIG. 1.

The container 10 is on its outside and its inside essentially cylindrical, in particular circular-cylindrical, with a vertically extending, longitudinal axis 12. The container 10 rests on a foundation 1 that may, for example, be a concrete slab, and that like the base area of the container 10 in plan view, may be circular or, as shown in the exemplary embodiment, may be a polygon. The cylindrical section of container 10 is covered at the top by a conical or a truncated cone-shaped roof 2.

The container 10 is manufactured by using a spiral-shaped, curved sheet strip 20, preferably directly at the erection site of the container 10. The diameter 14 of the container 10 may, for example, be between 4 m and 20 m or more. The height 16 of the container 10 may be between 2 m and 20 m or more. The filling capacity of the container 10 may, for example, be between 15 $m^3$ and 8000 $m^3$. The preferably homogenous thickness 26 (FIG. 4) of the sheet strip 20 is between 2 mm and 14 mm, and may in the present instance be in particular more than 5 mm, preferably more than 6 mm and less than 12 mm, for example between 8 mm and 10 mm. The width 18 of the sheet strip 20 may be between 20 cm and 100 cm, in particular between 30 cm and 80 cm and preferably between 40 cm and 60 cm. In the exemplary embodiment shown, the width 18 of the sheet strip 20 is approximately 50 cm.

Figure 3:
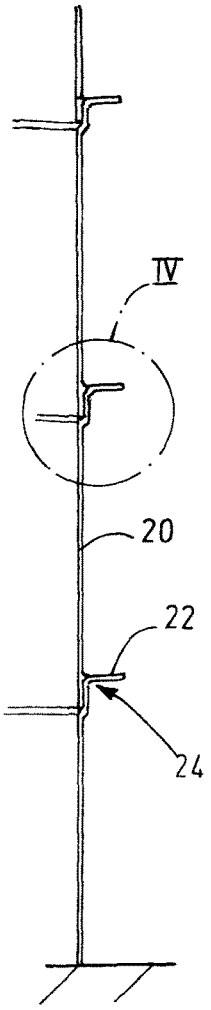
FIG. 3 is an enlarged side view in section of the side wall of the container in FIG. 1.
Figure 4:
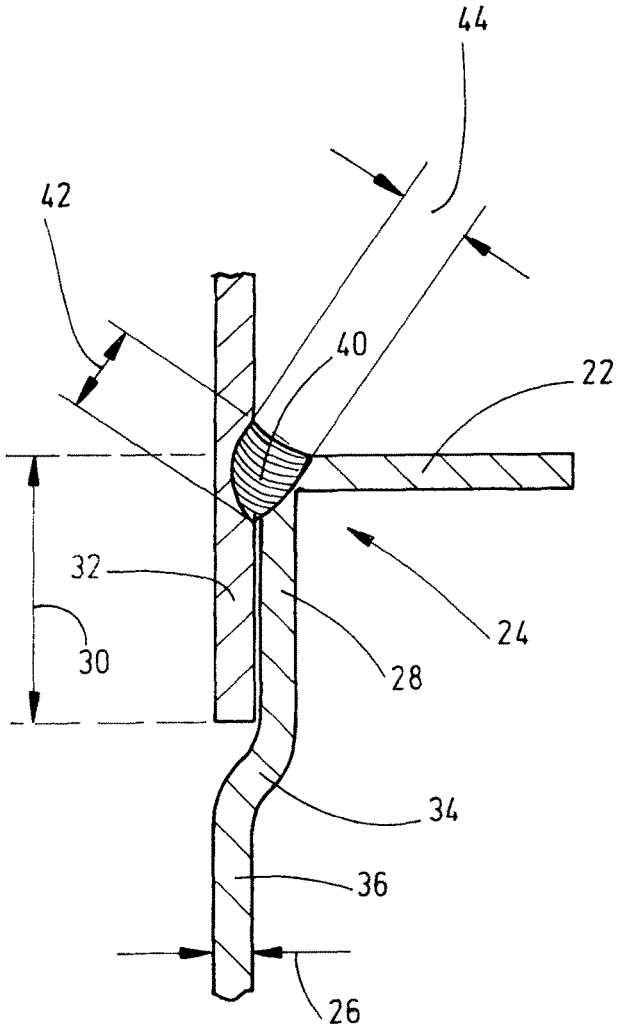
FIG. 4 is an enlarged side view in section through the connection point IV of the container in FIG. 1 according to a first exemplary embodiment of the invention.

FIG. 3 depicts in an enlarged representation a section of the side wall of the container 10 in FIG. 1. FIG. 4 depicts in an enlarged representation a section through the connection point IV of a first exemplary embodiment of the container 10 in FIG. 1. The sheet strip 20 features a first edge section 22 that forms the upper longitudinal edge of the sheet strip 20. First edge section 22 is folded out to the outside of the container 10 by forming a spiral-shaped fold-out edge 24. The radial extension of the folded-out, first edge section 22 is more than five times and less than ten times, in the exemplary embodiment approximately seven times the thickness 26 of the sheet strip 20.

A third section 28 of the sheet strip 20 in relation to the fold-out edge 24, is disposed opposite the first edge section 22, adjoins the fold-out edge 24, and is overlapped on the inside of the container 10 by a second edge section 32 of the sheet strip 20. In the area of the overlap 30, the second edge section 32 and the third section 28 extend essentially parallel to each other and extend in a curved manner particularly concentrically in relation to the longitudinal axis 12. They may have a constant distance from each other or may even lay alongside each other. The overlap 30 extends in vertical direction by more than two times, in particular more than three times and preferably more than five times, in the exemplary embodiment approximately seven times, the thickness 26 of the sheet strip 20. The overlap 30 may in particular be more than 50% and less than 200% of the radial extension of the folded-out, first edge section 22, in particular more than 80% and less than 125% and preferably more than 90% and less than 110%.

The third section 28 is shifted in particular radially to the outside by an offset 34 with respect to a fourth section 36 of the sheet strip 20 that adjoins the offset 34 in the direction towards the second edge section 32. In this instance the internal diameter of the container 10 is essentially the same in the vicinity of the fourth section 36 as in the vicinity of the second edge section 32, so that the second edge section 32 is able to rest on the inside of container 10 against the offset 34, or that the second edge section 32 and the fourth section 36 are at least flush on the inside of the container 10. The radial displacement of the third section 28 radially outwards compared to the fourth section 36 may correspond essentially to the thickness 26 of the sheet strip 20, or may even be slightly smaller, so that the third section 28 is retained alongside the second edge section 32 in particular by an elastic deformation of the sheet strip 20 in the vicinity of the offset 34.

On the outside of the container 10, in the vicinity of the fold-out edge 24, a welding seam 40 is provided to connect the second edge section 32 to the adjoining section of the sheet strip 20, in particular in the vicinity of the fold-out edge 24. In this instance the welding seam 40 extends at least partially into the area between the second edge section 32 and the third section 28. The height 42 of the welding seam 40 in the exemplary embodiment is more than 250% of the thickness 26 of the sheet strip 20 in the vicinity of the fold-out edge 24, and thus, provides a reliable, stable flow of force between the edge sections of the sheet strip 20 that adjoin each other in vertical direction, and gives the container 10 therefore a particularly high level of rigidity. The width 44 of the welding seam in the exemplary embodiment is more than 150% of the thickness 26 of the sheet strip 20, which width also contributes to the increase in rigidity of the welding connection and thus to that of container 10.

Figure 5:
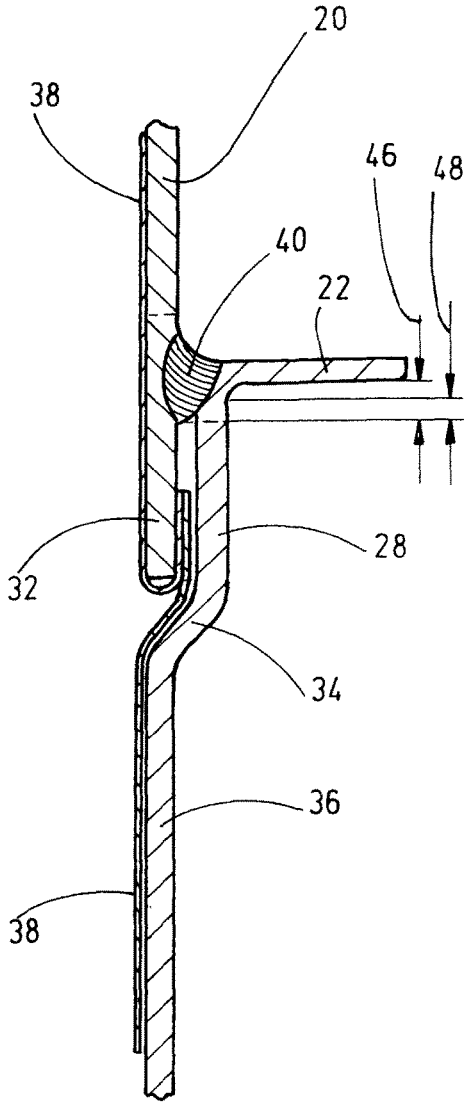
FIG. 5 is an enlarged side view in section through the connection point IV of the container of FIG. 1 according to a second exemplary embodiment of the invention.

The FIG. 5 depicts a second exemplary embodiment of the invention in the enlarged section of the connection point IV. The difference relative to the first exemplary embodiment is essentially that on the inside of the container 10 the sheet strip 20 is covered, and in particular laminated, with a thin lining 38, shown in the exemplary embodiment as a thin layer of stainless steel. This thin lining 38 provides the container with an increased resistance from any filling material and is, for example, also suitable for drinking water or other foodstuffs.

The height 46 of the first part of the welding seam 40, which extends in the area between the second edge section 32 and the third section 28 of the sheet strip 20, is in the exemplary embodiment more than the thickness 26 of the sheet strip 20. Even the second part 48 of the welding seam 40, which extends into the area between the second edge section 32 and the third section 28 that adjoins the fold-out edge 24, shows in the exemplary embodiment a thickness that is more than 30% of the thickness 26 of the sheet strip 20. If necessary, the welding seam 40 may extend even further into the area between the second edge section 32 and the third section 28 for the purpose of further increasing the mechanical strength of the welding connection, and thus, that of the container 10. Through the second part 48 of the height of the welding seam 40, which extends in that area where the second edge section 32 and the third section 28 extend parallel to each other, the connection is made also in a section of the sheet strip 20 that was not stressed, or not significantly stressed, through the folding out of the first edge section 22, which increases the mechanical strength of the connection.

Figure 6:
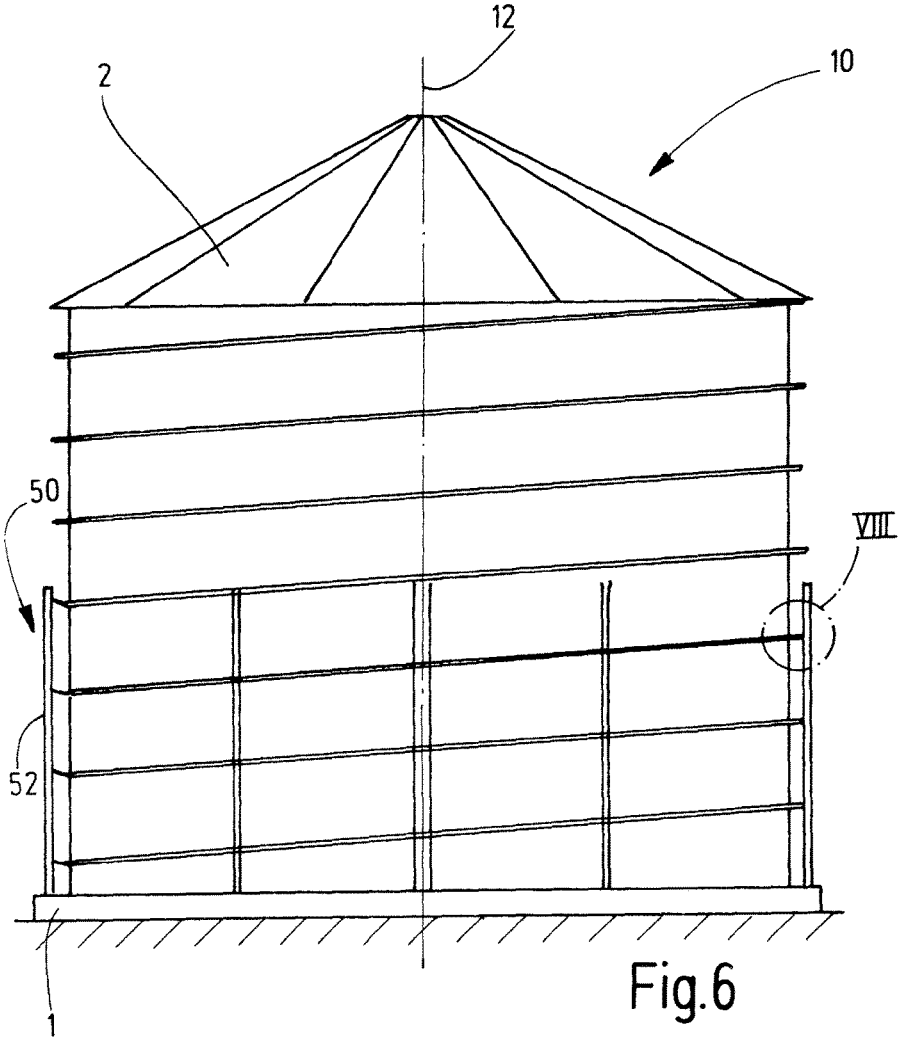
FIG. 6 is a side elevational view of the container according to a third exemplary embodiment of the invention.
Figure 7:
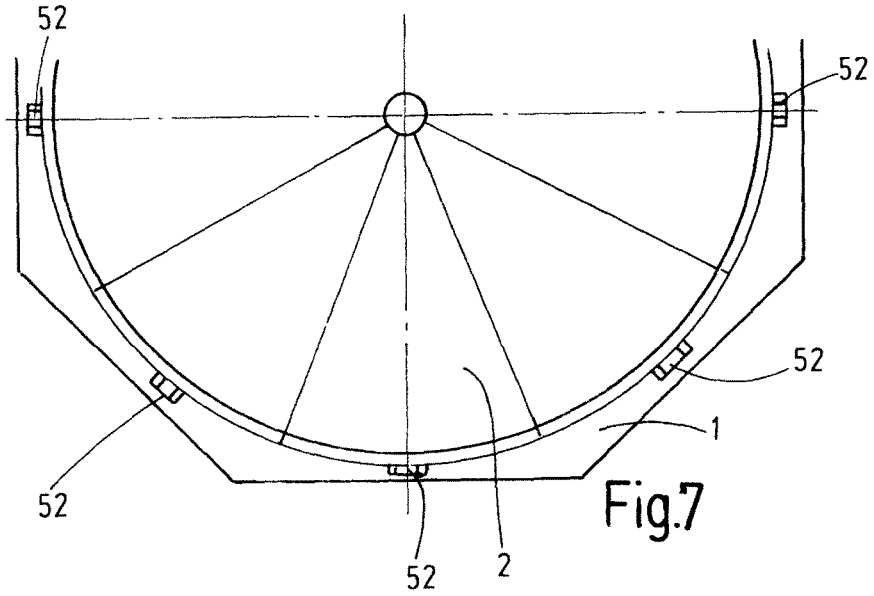
FIG. 7 is a partial plan view of the container of FIG. 6.

The FIG. 6 depicts a side elevational view of a third exemplary embodiment of the invention in which the container 10 may be constructed as described before, but is in addition surrounded by a stabilizing device 50. Stabilizing device 50 extends from the foundation 1 upwards and in the exemplary embodiment shown, is positively connected at discrete locations around the circumference of the container 10 to at least partially absorb the forces that act upon container 10. FIG. 7 shows in part the respective plan view. The stabilizing device 50 comprises a total of eight stabilizing elements 52 that are arranged equidistantly around the circumference of the container up to a height of approximately 50% of the container. Each stabilizing element 52 is connected to the outside of the container 10 punctiformly or linearly. The stabilizing elements 52 are sufficiently anchored in the foundation 1.

Figure 8:
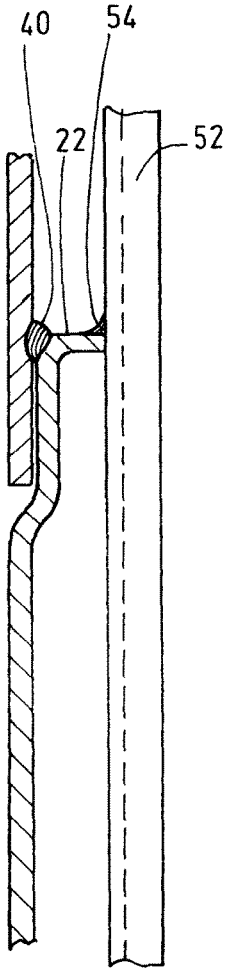
FIG. 8 is an enlarged side view in section of the side wall of the container of FIG. 6.
Figure 9:
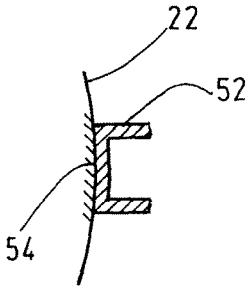
FIG. 9 is an end view in section through a stabilizing element of the container of FIG. 6.

FIG. 8 depicts enlarged a section of the side wall of the container 10 in FIG. 6. FIG. 9 shows a section through a stabilizing element 52 that is U-shaped in cross-section. The exemplary embodiment shows the stabilizing element 52 as a U-shaped iron profile to which the radially outer-most end of the first edge section 22 is attached by a further welding seam 54. The radial distance between the wall of the container 10 and the stabilizing element 52 may be less than fifteen times, in particular less than twelve times and preferably less than ten times the thickness of the sheet strip 20. Due to the radial orientation of the folded-out, first edge section 22, a high level of mechanical strength of the connection between the container 10 and the stabilizing element 52 is achieved, even at the comparatively large distances. The U-shape of the stabilizing elements 52 results in a high bending resistance with respect to forces that occur radially in relation to the longitudinal axis 12 of the container 10.

Figure 10:
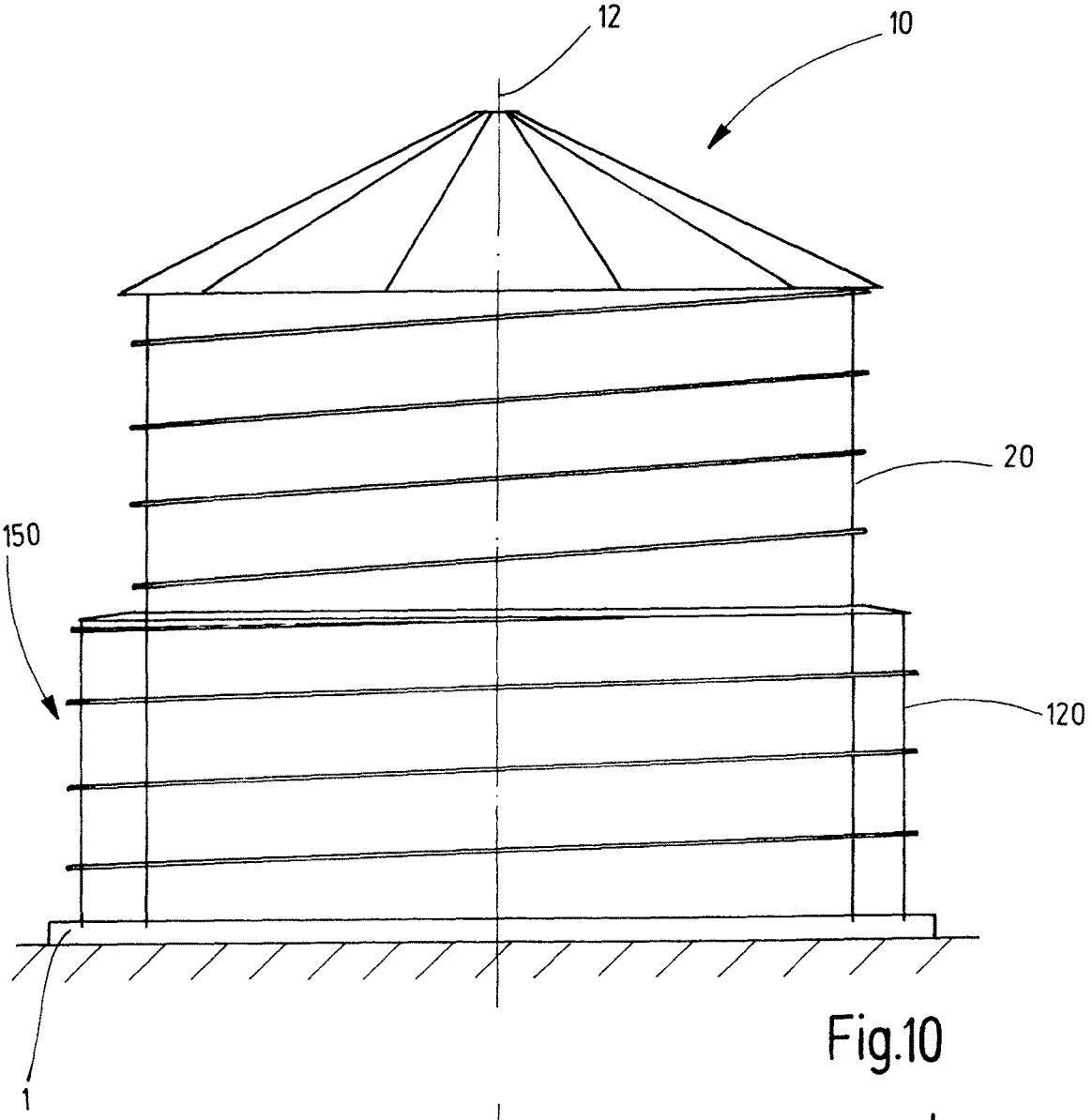
FIG. 10 is a side elevational view of a container according a fourth exemplary embodiment of the invention.
Figure 11:
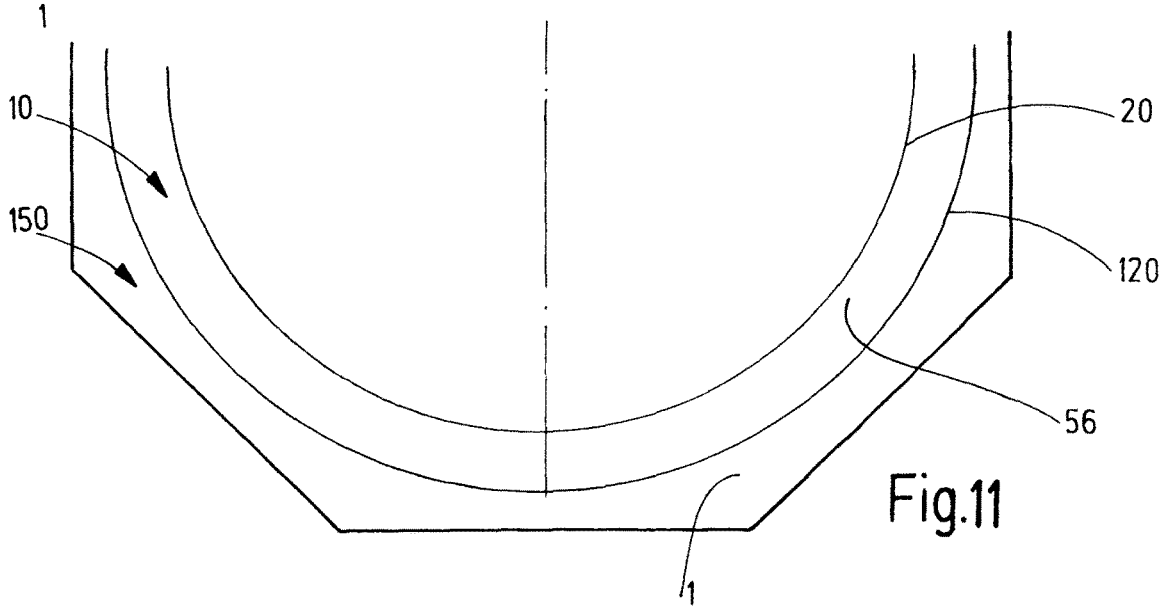
FIG. 11 is a partial plan view of the container of FIG. 10.

FIG. 10 depicts a side elevation of a fourth exemplary embodiment of the invention. FIG. 11 shows the corresponding partial plan view. Whilst the container 10 is constructed as described above, the stabilizing device 150 is now provided in form of an outer container, which surrounds the container 10 in the bottom section, preferably concentrically in relation to the longitudinal axis 12. The exemplary embodiment shows that the stabilizing device 150 is constructed similar to or identical with the container 10 from a spiral-shaped, curved sheet strip 120. In particular, the welding connection for the outer container of the stabilizing device 150 can be made in the same manner as described for the container 20. The positive connection between the container 10 and the stabilizing device 150 may be achieved in that the space 56 between the inner container 10, or its sheet strip 20 respectively, and the outer stabilizing device 150, or its sheet strip 120 respectively, is filled with a material 60 such as, for example, concrete.

Figure 12:
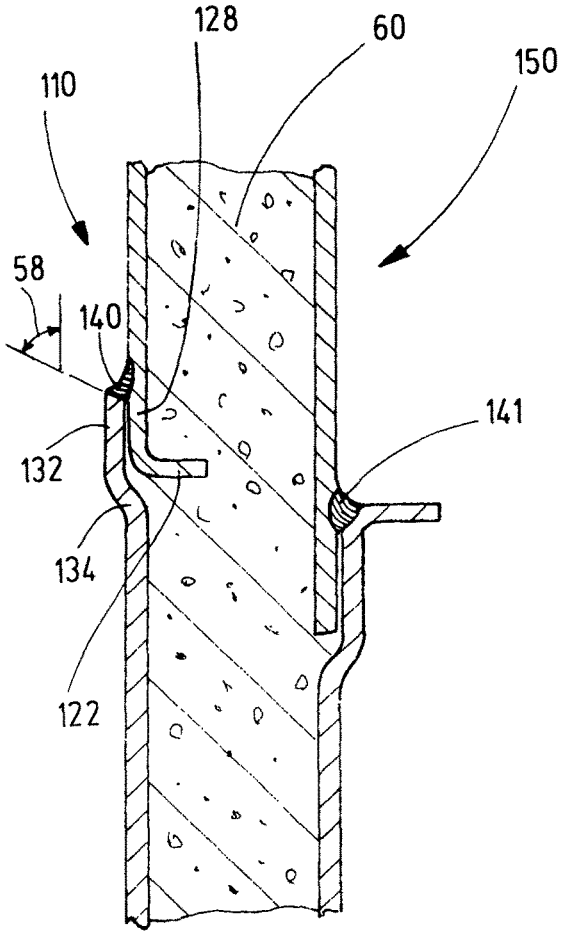
FIG. 12 is an enlarged side view in section of a container according to a fifth exemplary embodiment of the invention.

The FIG. 12 shows enlarged a section of a fifth exemplary embodiment of the invention in the area of the space 56 between the container 10 and the stabilizing device 150. In contrast to the exemplary embodiments described so far, the folded-out first edge section 122 in the container 110 is formed by the vertical lower longitudinal edge of the sheet strip 20, and the second edge section 132 is folded radially to the inside by offset 134. The connection between the second edge section 132 and the third section 128 is achieved through a welding seam 140 that is placed onto the end edge of the second end section 132. The end edge of the second end section 132 may form a step on the inside of the container 110 that forms an angle 58 to the vertical that is less than 90° and in particular is approximately 70° as shown in the exemplary embodiment. This angular end edge allows the welding seam 140 to be placed securely in the transition section from the second edge section 132 to the third section 128. In particular, due to the gravitational force the welding seam drops into the gap between the two sections of the sheet strip 20. Regarding its height and width, the welding seam 140 may otherwise be formed as described above for the welding seam 40.

The stabilizing device 150, made from the spiral-shaped, curved sheet strip 120, may be made in the same manner as described in relation with container 10, in particular concerning the arrangement and formation of the welding seam 141. Welding seam 41 may be formed in the same way as the above described welding seam 40 of container 10. The space 56 between the container 110 and the stabilizing device 150 is filled with concrete as a positive connecting material 60. In particular, by using the container 110 and the stabilizing device 150 as formwork, the material 60 may be filled into the space 56.

Figure 13:
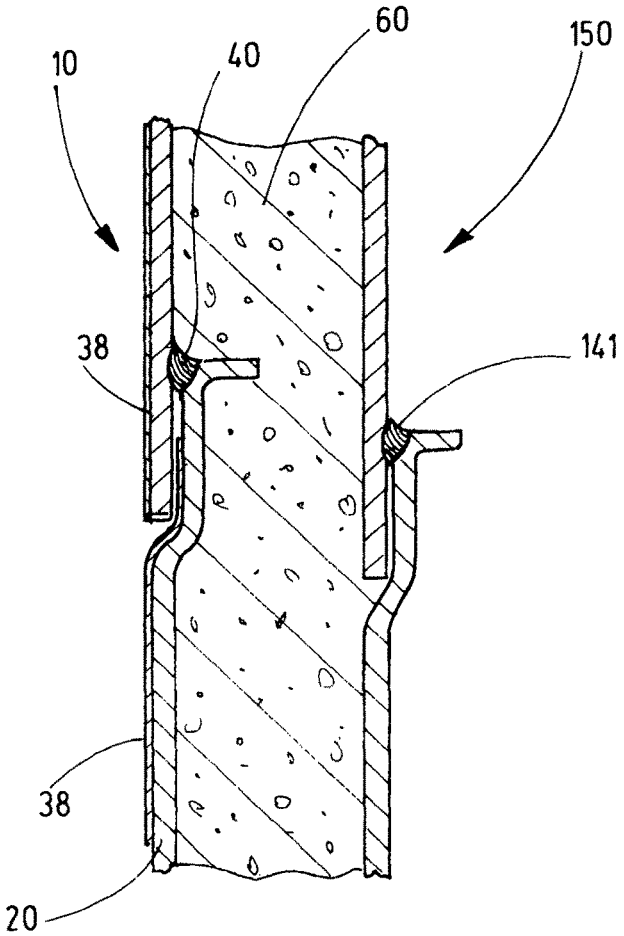
FIG. 13 is an enlarged side view in section of a container according to a sixth exemplary embodiment of the invention.

The FIG. 13 shows enlarged a sectional view through a sixth exemplary embodiment of the invention where, in contrast to the exemplary embodiment of FIG. 12, the container 10 is formed as described in connection with FIG. 5. The container 10 comprises on its inside a lining 38 made, for example, from stainless steel. The welding connection for container 10 and for the stabilizing device 150 is made radially outside through the welding seams 40 and 141, respectively. As a result of the material 60 in the space between the container 10 and the stabilizing device 150, the welding seam 40 of container 10 is provided with further mechanical stabilization.

While various embodiments have been chosen to illustrate the invention, it will be understood by those skilled in the art that various changes and modifications can be made therein without departing from the scope of the invention as defined in the claims.

The invention claimed is:

1. A container, comprising:

a spiral strip being elongated and being wound circumferentially about and axially along a longitudinal axis, said spiral strip including first edge section being spiral shaped and folded in a direction toward or away from said longitudinal axis forming a spiral-shaped fold out edge and including a spiral-shaped second edge section disposed opposite said first edge section relative to a longitudinal direction of said spiral strip, said second edge section overlapping a third section of said spiral strip, said third section being disposed opposite said fold out edge between said first edge section and said third section; and a single welding seam connecting said second edge section and said third section in a vicinity of overlapping of said second edge section and said third section, said welding seam extending at least partially into an area between said second edge section on said third section from outside said area.

2. A container according to claim 1 wherein said welding seam has a height more than 100% of a thickness of said sheet strip.

3. A container according to claim 1 wherein said welding seam has a height more than 120% of a thickness of said sheet strip.

4. A container according to claim 1 wherein
said welding seam has a height more than 150% of a thickness of said sheet strip.

5. A container according to claim 1 wherein
said welding seam has a height extending in an area between said second edge section and said third section more than 20% of a thickness of said sheet strip.

6. A container according to claim 1 wherein
said welding seam has a height extending in an area between said second edge section and said third section more than 25% of a thickness of said sheet strip.

7. A container according to claim 1 wherein
said welding seam has a height extending in an area between said second edge section and said third section more than 30% of a thickness of said sheet strip.

8. A container according to claim 1 wherein
said welding seam extends into an area in which said second edge section and said third section extend parallel to one other.

9. A container according to claim 1 wherein
said second edge section overlaps said third section inside the container.

10. A container according to claim 1 wherein
said welding seam is on an outside surface of the container.

11. A container according to claim 1 wherein
said second edge section is welded at a spiral-shaped end edge of said third section.

12. A container according to claim 1 wherein
an end edge of said second edge section is inside the container and forms a step extending obliquely to said longitudinal axis.

13. A container according to claim 1 wherein
an end edge of said second edge section is inside the container and forms a step extending perpendicularly to said longitudinal axis.

14. A container according to claim 1 wherein
a stabilizer surrounds the container and extends upwardly from a support surface of the container, said stabilizer being positively connected to the container in at least one of sections or discrete positions of the container, thereby at least partially absorbing forces acting on the container.

15. A container according to claim 1 wherein
an outer container surrounds the container; and
an annular space is between the container and said outer container, said annular space being filled at least in sections thereof with a material providing a positive connection between the container and said outer container.

16. A container according to claim 15 wherein
said outer container comprises an elongated spiral-shaped strip wound circumferentially about and axially along said longitudinal axis.

17. A container according to claim 1 wherein
said weld seam extends directly between and directly connects an intermediate portion of said second edge section to a joint between said first edge section and said third section, said intermediate portion being spaced from an end edge of said second edge section.

18. A container, comprising:
a spiral strip being elongated and being wound circumferentially about and axially along a longitudinal axis, said spiral strip including a first edge section being spiral shaped and folded in a radial direction toward or away from said longitudinal axis and including a spiral-shaped second edge section disposed adjacent said first edge section, said second edge section overlapping a third section of said spiral strip; and
a single welding seam extending directly between and directly connecting an intermediate portion of said second edge section to a joint between said first edge section and said third section, said intermediate portion being spaced from an end edge of said second edge section, said welding seam being spiral shaped.

19. A container according to claim 18 wherein
said end edge of said second edge section is adjacent an offset step extending at an angle to said longitudinal axis and being on said third section.

* * * * *